US005701563A

United States Patent [19]

Fukuda et al.

[11] Patent Number: 5,701,563

[45] Date of Patent: Dec. 23, 1997

[54] DEVELOPING APPARATUS AND IMAGE-FORMING APPARATUS USING THE SAME

[75] Inventors: Yoshiyuki Fukuda; Katsura Kojima; Tadashi Sugiyama, all of Shizuoka-ken, Japan

[73] Assignee: Kabushiki Kaisha TEC, Shizuoka, Japan

[21] Appl. No.: 598,230

[22] Filed: Feb. 7, 1996

[30] Foreign Application Priority Data

Feb. 14, 1995 [JP] Japan ..... 7-024962

[51] Int. Cl.[6] ..... G03G 15/08

[52] U.S. Cl. ..... 399/284; 399/281

[58] Field of Search ..... 355/259, 260, 355/245; 118/653, 651; 430/120

[56] References Cited

U.S. PATENT DOCUMENTS

| | | | |
|---|---|---|---|
| 5,132,734 | 7/1992 | Momiyama et al. | 355/253 |
| 5,155,532 | 10/1992 | Sakurada et al. | 355/245 |
| 5,170,213 | 12/1992 | Yamaguchi et al. | 355/246 |
| 5,179,414 | 1/1993 | Bhagat | 355/259 |
| 5,235,387 | 8/1993 | Sato et al. | 355/245 |
| 5,239,345 | 8/1993 | Kikuchi et al. | 355/259 |
| 5,317,370 | 5/1994 | Kohyama et al. | 355/245 |
| 5,333,040 | 7/1994 | Imamiya | 355/246 |
| 5,367,367 | 11/1994 | Ikeda et al. | 355/245 |
| 5,369,478 | 11/1994 | Kobayashi et al. | 355/259 |
| 5,404,211 | 4/1995 | Hashimoto et al. | 355/259 |
| 5,424,817 | 6/1995 | Imamiya et al. | 355/261 |
| 5,450,176 | 9/1995 | Unemo et al. | 355/245 |
| 5,495,322 | 2/1996 | Wada et al. | 355/260 |
| 5,502,552 | 3/1996 | Iwata et al. | 355/259 |
| 5,548,386 | 8/1996 | Fukuda | 355/259 |

FOREIGN PATENT DOCUMENTS

| | | |
|---|---|---|
| 3-116169 | 5/1991 | Japan . |
| 4-474 | 1/1992 | Japan . |
| 6-11967 | 1/1994 | Japan . |

*Primary Examiner*—R. L. Moses

*Attorney, Agent, or Firm*—Frishauf, Holtz, Goodman, Langer & Chick

[57] ABSTRACT

A developing apparatus includes a housing having a toner holding space and toner discharging aperature, a developing roller rotated in a predetermined direction in the aperature, a toner leveling member closing a gap between a periphery of the developing roller and an edge of the aperture at which the periphery of the developing roller is moved out from the aperture in its predetermined rotating direction, and slidably pressed against the periphery of the developing roller, a toner supplying roller rotated in the space and pressed against the periphery of the developing roller, and a sliding and closing member closing a gap between the periphery of the supplying roller and a portion of the inner surface of the housing corresponding to a gap between the periphery of the developing roller and an edge of the aperture at which the periphery of the developing roller is moved into the aperature in its predetermined rotating direction, and slidably pressed against the periphery of the supplying roller.

26 Claims, 4 Drawing Sheets

DEVELOPING APPARATUS AND IMAGE-FORMING APPARATUS USING THE SAME

BACKGROUND OF THE INVENTION

1. Field of the Invention

This invention relates to a developing apparatus for developing a latent image on a surface of an image carrier with toner, and to an image-forming apparatus for transferring a toner image developed by such a developing apparatus onto a printing medium and fixing the transferred image thereon.

2. Description of the Related Art

Firstly, a conventional image-forming apparatus of the above described type will be schematically described with reference to FIG. 8. FIG. 8 shows schematically a longitudinal cross section of the conventional image-forming apparatus. The conventional image-forming apparatus comprises an image carrier 12 such as a photosensitive drum in a housing 10, and an electrifying means 14, an exposing means 16, a developing apparatus 18 and a transferring means 20 are arranged in the housing 10 around the image carrier 12 in the cited order in a rotational direction of the image carrier 12 as indicated by an arrow in FIG. 8 (the clockwise direction in FIG. 8). The image-forming apparatus further comprises a printing medium supplying means 22 for supplying a printing medium such as a sheet of paper which has a predetermined dimensions to a position of the image carrier 12 facing to the transferring means 20 on the image carrier 12, a discharged paper tray 24 on which the printing medium that has passed the transferring means facing position of the image carrier 12 is discharged, and a fixing means 26 arranged along a printing medium path extending from the facing position of the image carrier 12 to the discharged paper tray 24.

The electrifying means 14 charges a peripheral surface of the image carrier 12 evenly with electric charge. The exposing means 16 exposes the electrically charged peripheral surface of the image carrier 12 by an exposing light beam **16*a* in accordance with printing data supplied thereto to form a latent image corresponding to the printing data on the peripheral surface. The developing apparatus 18 supplies the peripheral surface of the image carrier 12 with the toner, develops the latent image and forms a toner image corresponding to the latent image. The printing medium supplying means 22 includes a paper cassette 22*a* to which a number of printing media such as sheets of paper each of which has the predetermined dimensions are supplied, and a paper supplying roller 22*b* for supplying the printing media one by one from the paper cassette 22*a* to the transferring means facing position of the image carrier 12 in a predetermining timing. The paper supplying roller 22*b* supplies the printing medium in such a way that the printing media reaches at the transferring means facing position when the toner image on the peripheral surface of the image carrier 12 arrives at the transferring means facing position. The transferring means 20 transfers the toner image on the peripheral surface of the image carrier 12 onto the printing medium supplied from the printing medium supplying means 22, and the fixing means 26 heats the transferred toner image on the printing medium by, for example, a pair of heating rollers so that the transferred image is fixed on the printing medium while the printing media is moved from the facing position toward the discharged paper tray 24. The printing medium on which the toner image have been fixed is discharged to the discharged paper tray 24** and is held.

Now, the conventional developing apparatus 18 used in the conventional image-forming apparatus of FIG. 8 will be described by referring to FIG. 9 which shows a longitudinal cross sectional view of the developing apparatus 18. The conventional developing apparatus 18 comprises a housing 28 having a toner holding space **28*a* for holding toner (in this conventional case, the toner is a non-magnetic single component type) and a toner discharging aperture 28*b* for discharging the toner 26 held in the toner holding space 28*a***.

The toner discharging aperture **28*b* is formed at a region in a lower end portion of a peripheral wall of the housing 28, the region facing the peripheral surface of the image carrier 12. The developing apparatus 18 further has a developing roller 30 rotatably arranged in the toner discharging aperture 28*b*. The developing roller 30 is arranged to contact or very close to the image carrier 12, and its peripheral surface is formed with conductive rubber. The developing roller 30 is rotated in a predetermined rotational direction (the counterclockwise direction in FIG. 9) indicated by an arrow in FIG. 9 opposite to the predetermined rotational direction of the image carrier 12 indicated by the arrow in FIG. 9 (the clockwise direction in FIG. 9) while the image carrier 12** is rotated.

In the toner holding space **28*a*, a toner supplying roller 32 that is located inside relative to the developing roller 30 and being in contact with the latter, is rotatably arranged. The peripheral surface of the toner supplying roller 32 is formed with an elastic material such as sponge. The toner supplying roller 32 is rotated in a predetermined direction indicated by an arrow in FIG. 9 (the counterclockwise direction in FIG. 9) and being the same rotational direction as that of the developing roller 30 as indicated by the arrow in FIG. 9 (the counterclockwise direction in FIG. 9) while the developing roller 30** is rotated.

In the toner holding space **28*a*, a toner stirring member 34 that is located in an lower end portion of the toner holding space 28*a* at an inner position relative to the toner supplying roller 32, is further rotatably arranged. The toner stirring member 34 is rotated in a predetermined direction indicated by an arrow in FIG. 9 (the clockwise direction in FIG. 9) opposite to the predetermined rotational direction (the counterclockwise direction in FIG. 9) of the toner supplying roller 32 in order to move forcibly the toner 26 in the lower end portion of the toner holding space 28*a* toward the toner supplying roller 32 while the toner supplying roller 32** is rotated.

At an edge of the toner discharging aperture **28*b* on a peripheral surface of the housing 28, the edge being located in an exit side at which the peripheral surface of the developing roller 30 is moved out from the toner discharging aperture 28*b* when the developing roller 30 is rotated in the predetermined direction indicated by the arrow in FIG. 9 (the counterclockwise direction in FIG. 9), a toner leveling member 36 is fixed to close a gap between the exit side edge and the peripheral surface of the developing roller 30 and to slidably contact the peripheral surface of the developing roller 30**.

At another edge of the toner discharging aperture 28 on the peripheral surface of the housing 28, the edge being located in an entrance side at which the peripheral surface of the developing roller 30 is moved into the toner discharging aperture **28*b* when the developing roller 30 is rotated in the predetermined direction indicated by the arrow in FIG. 9 (the counterclockwise direction in FIG. 9), a toner collecting member 38 is fixed to slidably pressed against the peripheral surface of the developing roller 30**.

A toner inlet opening 28c is formed at an upper end of the housing 28, and a toner cartridge 40 is removably fitted or integrally formed with the upper end. The toner cartridge 40 has a toner discharge opening 40a facing the toner inlet opening 28c of the housing 28.

If the toner cartridge 40 is the removable type, the toner discharge opening 40a of the toner cartridge 40 is sealed by a sealing film 42 with the toner 26 being filled up to the two-dots chain line in FIG. 9 in an inner space of the toner cartridge 40 before the toner cartridge 40 is fitted to the upper end of the housing 28. After the image-forming apparatus of FIG. 8 is installed at a place in which the image-forming apparatus is used, the removable type toner cartridge 40 is fitted to the upper end of the housing 28 and the sealing film 42 is removed so that the toner 26 in the toner cartridge 40 is supplied into the toner holding space 28a through the toner discharge opening 40a and the toner inlet opening 28c of the housing 28.

If the toner cartridge 40 is integrally formed with the housing 28, the toner discharge opening 40a is sealed by the sealing film 42 with the toner 26 being filled up to the two-dots chain line in FIG. 9 in the inner space of the toner cartridge 40 before the image-forming apparatus of FIG. 8 is installed at the place in which the image-forming apparatus is used. The toner 26 is supplied into the toner holding space 28a through the toner discharge opening 40a of the toner cartridge 40 and the toner inlet opening 28c of the housing 28 after the image-forming apparatus of FIG. 8 is installed at its using place and the sealing film 42 is removed from the toner discharge opening 40a.

When the image carrier 12 is rotated in the predetermined direction indicated by the arrow in FIG. 9 (the clockwise direction in FIG. 9) to form an image after the toner 26 is supplied into the toner holding space 28a of the housing 28 from the toner cartridge 40 at the using place of the image-forming apparatus, the developing roller 30, the toner supplying roller 32 and the toner stirring member 34 are rotated in their respective predetermined rotational directions indicated respectively by arrows in FIG. 9. Consequently, the toner 26 held in the toner holding space 28a is applied to the peripheral surface of the developing roller 30 through the toner stirring member 34 and the toner supplying roller 32, the applied toner is leveled by the toner leveling member 36 to have a predetermined thickness on the peripheral surface, and the leveled toner is applied to the peripheral surface of the image carrier 12 by the developing roller 30 to develop the latent image on the image carrier 12. The toner 26 having been not used for the development and remaining on the peripheral surface of the developing roller 30 is collected by the toner collecting member 38 and put back into the toner holding space 28a.

In the conventional image-forming apparatus of FIG. 8 structured as described above and using the conventional developing apparatus 18 of FIG. 9 structured as described above, a reason for that the toner 26 is not supplied from the toner cartridge 40 into the toner holding space 28a of the housing 28 after the image-forming apparatus is shipped from a factory and before the image-forming apparatus is installed at the using place, is as follows.

In order to ensure a desired smooth rotation of the developing roller 30, the pressure applied to the developing roller 30 by the toner collecting member 38 is set lower than the pressure applied to the developing roller 30 by the toner leveling member 36. Therefore, if the image-forming apparatus is shipped from the factory with the toner holding space 28a of the housing 28 holding the toner 26 therein, a gap can be produced between the peripheral surface of the developing roller 30 and the toner collecting member 38 which is pressed against the developing roller 30 with a relatively low pressure when relatively large vibration and/or impact is applied to the image-forming apparatus on the way from the factory to the using place of the image-forming apparatus. Then, the toner 26 in the toner holding space 28a can leak out through the gap to contaminate various components in an outer housing of the image-forming apparatus. Needless to say, it is very cumbersome to clean the contaminated components and the toner 26 adhering to the components of the image-forming apparatus can give various troubles to the components (that is, the image-forming apparatus).

The conventional developing apparatus 18 which needs the toner cartridge 40 sealed by the sealing film 42 owing to the above described reasons and the conventional image-forming apparatus using the conventional developing apparatus 18 have drawbacks as described fellows.

(1) The toner cartridge 40 having the inner space substantially as large as the toner holding space 28a of the housing 28 increases overall outer dimensions of the developing apparatus 18 and hence those of the image-forming apparatus using such an developing apparatus 18.

(2) The toner cartridge 40 provided with the sealing film 42 and added to the toner holding space 28a of the housing 28 raises a manufacturing cost of the developing apparatus 18 and hence that of the image-forming apparatus using such an developing apparatus 18.

(3) When the sealing film 42 is removed from the toner cartridge 40, the toner adhering to the sealing film 42 can contaminate a person who removes the sealing film 42 and its clothes.

SUMMARY OF THE INVENTION

This invention is derived from the above described circumstances, and an object of this invention is to provide a developing apparatus that does not require a toner cartridge being independent of a toner holding space of a housing and provided with a sealing film, that can decrease a size and a manufacturing cost of the developing apparatus and these of an image forming apparatus using the developing apparatus, and that can prevent a toner from leaking out if the toner is filled in the toner holding space of the housing of the developing apparatus before the image forming apparatus is shaped from the factory for it and if the image-forming apparatus is subjected to relatively large vibration and/or impact during transportation of the image-forming apparatus from the factory to a place at which the image-forming apparatus is used, and to provide the image-forming apparatus using the developing apparatus.

According to a first aspect of the invention, the above object is achieved by providing a developing apparatus for developing a latent image formed on a surface of an image carrier with toner, comprising:

a housing having a toner holding space for holding the toner and a toner discharging aperture for discharging the toner in the toner holding space to the outer space;

a developing roller rotatably held in the toner discharging aperture of the housing and rotated in a predetermined direction;

a toner leveling member closing a gap between a peripheral surface of the developing roller and an edge of the toner discharging aperture at which the peripheral surface of the developing roller is moved out from the toner discharging aperture in the predetermined rotating direction of the developing roller, and slidably pressed against the peripheral surface of the developing roller;

a toner supplying roller rotatably held in the toner holding space and pressed against the peripheral surface of the developing roller; and a sliding and closing member closing a gap between the peripheral surface of the toner supplying roller and a portion of the inner surface of the housing corresponding to a gap between the peripheral surface of the developing roller and an edge of the toner discharging aperture at which the peripheral surface of the developing roller is moved into the toner discharging aperture in the predetermined rotating direction of the developing roller, and slidably pressed against the peripheral surface of the toner supplying roller, wherein the peripheral surface of the developing roller is arranged to face the surface of the image carrier on which the latent image is formed, the toner is supplied to the peripheral surface of the developing roller in the toner holding space by the rotation of the toner supplying roller, the toner is leveled by the toner leveling member on the peripheral surface of the developing roller by the rotation of the developing roller in its predetermined rotating direction, the toner is supplied from the peripheral surface of the developing roller to the surface of the image carrier, and the latent image on the surface of the image carrier is developed by the toner.

According to a second aspect of the invention, the above object is achieved by providing an image-forming apparatus comprising:

an image carrier on a surface of which a latent image is formed;

an developing apparatus for developing the latent image formed on the surface of the image carrier with toner;

a printing medium supplying means for supplying a printing medium to the image carrier; and a transferring/fixing means for transferring the toner image on the image carrier developed by the developing apparatus onto the printing medium supplied by the printing medium supplying means, and fixing the transferred image on the printing medium; wherein the developing apparatus includes:

a housing having a toner holding space for holding the toner and a toner discharging aperture for discharging the toner in the toner holding space to the outer space;

a developing roller rotatably held in the toner discharging aperture of the housing and rotated in a predetermined direction;

a toner leveling member closing a gap between a peripheral surface of the developing roller and an edge of the toner discharging aperture at which the peripheral surface of the developing roller is moved out from the toner discharging aperture in the predetermined rotating direction of the developing roller, and slidably pressed against the peripheral surface of the developing roller;

a toner supplying roller rotatably held in the toner holding space and pressed against the peripheral surface of the developing roller; and a sliding and closing member closing a gap between the peripheral surface of the toner supplying roller and a portion of the inner surface of the housing corresponding to a gap between the peripheral surface of the developing roller and an edge of the toner discharging aperture at which the peripheral surface of the developing roller is moved into the toner discharging aperture in the predetermined rotating direction of the developing roller, and slidably pressed against the peripheral surface of the toner supplying roller, wherein the peripheral surface of the developing roller is arranged to face the surface of the image carrier on which the latent image is formed, the toner is supplied to the peripheral surface of the developing roller in the toner holding space by the rotation of the toner supplying roller, the toner is leveled by the toner leveling member on the peripheral surface of the developing roller by the rotation of the developing roller in its predetermined rotating direction, the toner is supplied from the peripheral surface of the developing roller to the surface of the image carrier, and the latent image on the surface of the image carrier is developed by the toner.

In each of the developing apparatus according to the invention and the image-forming apparatus according to the invention, the gap between the peripheral surface of the developing roller and the edge of the toner discharging aperture at which the peripheral surface of the developing roller is moved out from the toner discharging aperture in the predetermined rotating direction of the developing roller is closed by the toner leveling member slidably pressed against the peripheral surface of the developing roller. Further, the gap between the peripheral surface of the developing roller and the edge of the toner discharging aperture at which the peripheral surface of the developing roller is moved into the toner discharging aperture in the predetermined rotating direction of the developing roller is closed by the sliding and closing member slidably pressed against the peripheral surface of the toner supplying roller. More further, the toner supplying roller contacts the developing roller. Therefore, the toner discharging aperture of the housing of the developing apparatus is closed by the toner leveling member, the developing roller, the toner supplying roller and the sliding and closing member.

Since the toner leveling member is slidably pressed against the developing roller and the sliding and closing member is slidably pressed against the toner supplying roller, the toner leveling member and the sliding and closing member can be slidably pressed against the developing roller and the toner supplying roller respectively with a relatively high pressure that can firmly prevent the toner leveling member and the sliding and closing member from removing off from the developing roller and the toner supplying roller respectively even if the image-forming apparatus using the above described developing apparatus is subjected to relatively large vibration and/or impact after the image-forming apparatus is shipped from the factory and before it is arrived at the place at which the image-forming apparatus is used, while keeping desired smooth rotating of each of the developing roller and the toner supplying roller.

Thus, if the toner holding space of the housing of the developing apparatus is filled with toner before the image-forming apparatus is shipped from the factory, no toner would leak out from the developing apparatus when the image-forming apparatus is subjected to relatively large vibration and/or impact after the image-forming apparatus is shipped from the factory and before the image-forming apparatus is arrived at the using place thereof. Since the developing apparatus of this invention does not require a toner cartridge being independent of the toner holding space of the housing and is provided with a sealing film, the developing apparatus and the image-forming apparatus using the developing apparatus can decrease their outer sizes and manufacturing cost.

It is preferable that each of the developing apparatus according to the invention and the image-forming apparatus using the developing apparatus and according to the invention further comprises a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

If the sliding and closing member and/or the toner supplying roller are worn in accordance with an increase of the operating time of the developing apparatus according to the invention and the image-forming apparatus using the developing apparatus and according to the invention, and thus the pressure applied to the toner supplying roller by the sliding and closing member is reduced to produce a gap between the toner supplying roller and the sliding and closing member so that the toner can be leaked out through the gap, the partitioning projection effectively prevents the toner from leaking out from the developing apparatus through the gap between the peripheral surface of the developing roller and the edge of the toner discharging aperture at which the peripheral surface of the developing roller is moved into the toner discharging aperture in the predetermined direction of the developing roller.

In the developing apparatus according to the invention and in the image-forming apparatus using the developing apparatus and according to the invention, it is preferable that the sliding and closing member is pressed onto a peripheral surface of the toner supplying roller by a depth of about 0.1 mm to about 3.0 mm, and more preferably that the depth is about 0.4 mm to about 1.00 mm.

The depth of about 0.4 mm to about 1.0 mm brings a superior sealing effect of the sliding and closing member to the toner supplying roller while the image-forming apparatus is transferred, a superior durability of the toner supplying roller and a superior toner-clogging preventing effect that prevents the toner from clogging at a position on the peripheral surface of the toner supplying roller at which the sliding and closing member is pressed against the toner supplying roller. The depth of about 0.1 mm to less than 0.4 mm (not including 0.4 mm) and more than 1 mm (not including 1 mm) to about 3.0 mm can bring the sealing effect and the toner-clogging preventing effect both of which are slightly inferior to those brought by the depth of about 0.4 mm to about 1 mm but there is no problem in practical use.

In the developing apparatus according to the invention and the image-forming apparatus using the developing apparatus and according to the invention, the sliding and closing member may be provided with an elastic member in a region where the sliding and closing member is in sliding contact with the peripheral surface of the toner supplying roller. With such an arrangement, the above described sealing effect, the above described durability and the above described toner-clogging preventing effect can be achieved easily and effectively.

In the developing apparatus according to the invention and the image-forming apparatus using the developing apparatus and according to the invention, the elastic member may be provided with a film or tape of a polymeric material in a region where the elastic member is in sliding contact with the peripheral surface of the toner supplying roller. The film or tape of the polymeric material can bring further easily and effectively the above described sealing effect, the above described durability and the above described toner-clogging preventing effect.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Now, various embodiments of the developing apparatus according to the invention and one embodiment of the image-forming apparatus using some of such embodiments of the developing apparatus and according to the invention will be described in detail with reference to FIGS. 1 through 7 of the attached drawings.

Figure 1:
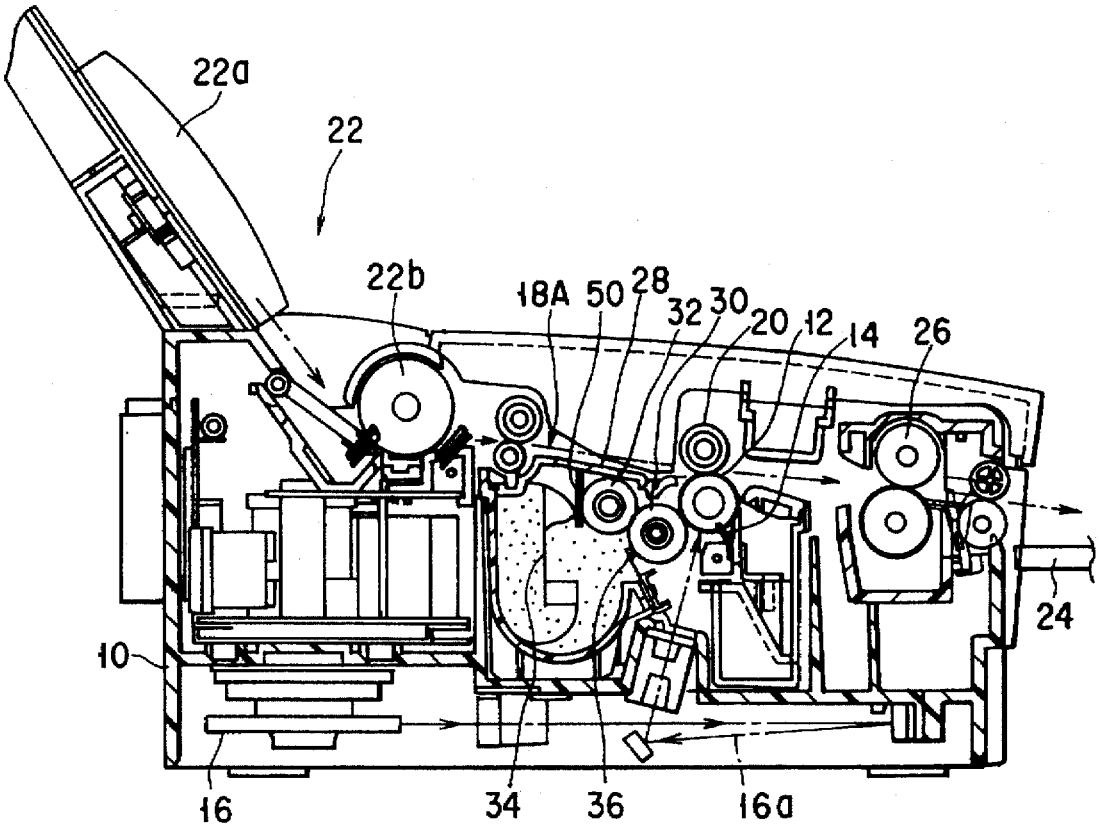
FIG. 1 is a longitudinal cross sectional view schematically showing a structure of one embodiment of an image-forming apparatus according to the invention and using a first embodiment of a developing apparatus according to the invention.

FIG. 1 is a longitudinal cross sectional view schematically showing a structure of one embodiment of the image-forming apparatus according to the invention and using a first embodiment of the developing apparatus according to the invention. Since a basic structure of the embodiment of the image-forming apparatus of FIG. 1 is the same as that of the conventional image-forming apparatus described above in detail with reference to FIG. 8, the components of the embodiment of FIG. 1 that are the same as or similar to those of FIG. 8 are respectively denoted by the same reference symbols as those denoting the corresponding components of FIG. 8, and their detailed description will be omitted.

Figure 8:
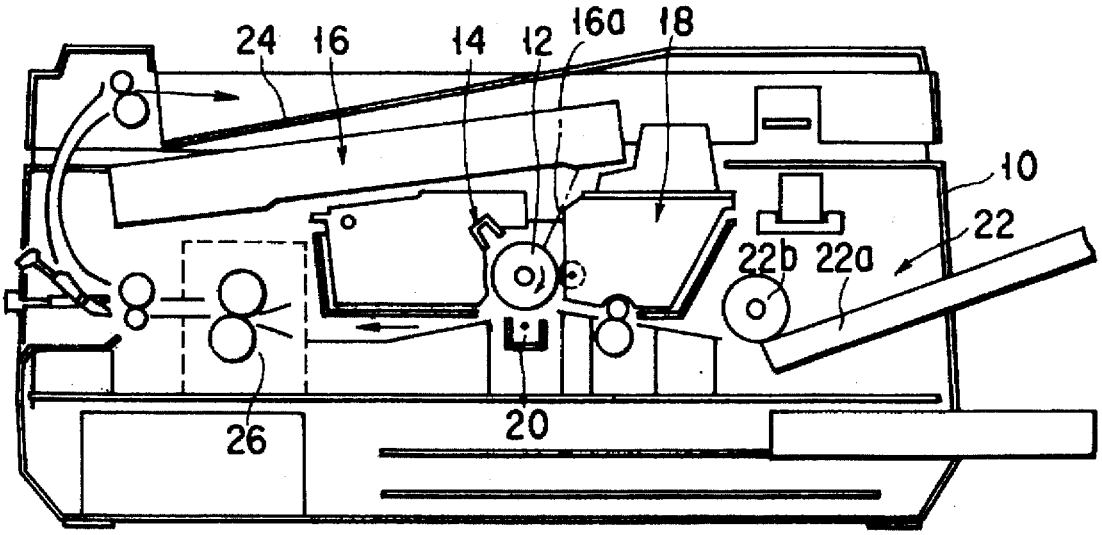
F I G. 8 PRIOR ART
FIG. 8 is a longitudinal cross sectional view schematically showing a structure of a conventional image-forming apparatus using a conventional developing apparatus.
Figure 9:
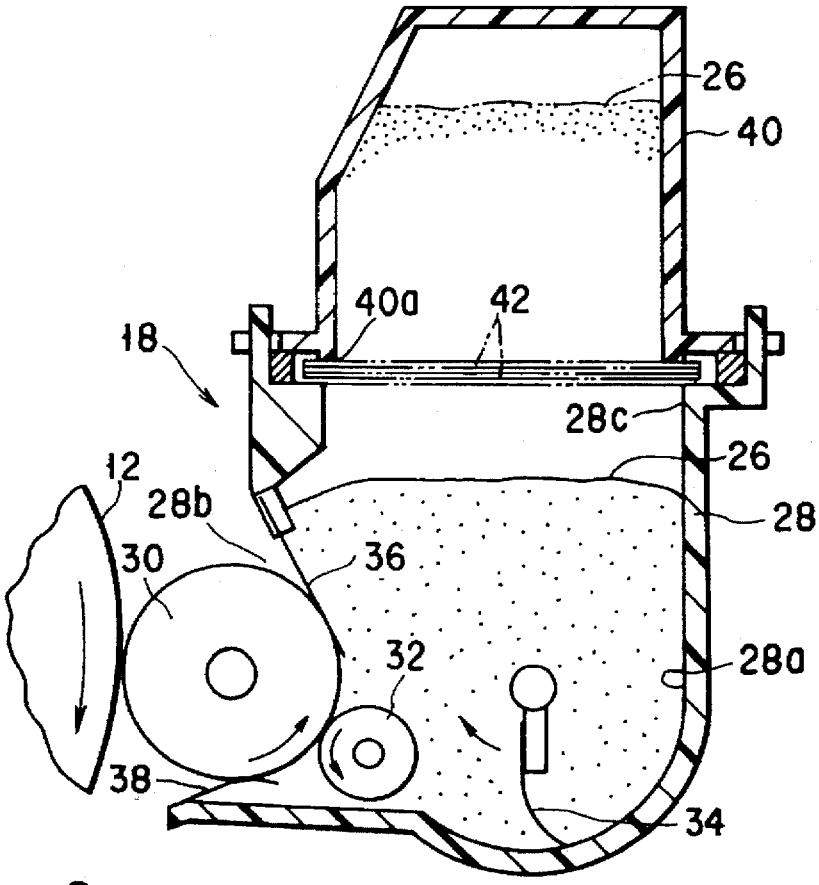
F I G. 9 PRIOR ART
FIG. 9 is a longitudinal cross sectional view schematically showing a structure of the conventional developing apparatus used in the conventional image-forming apparatus of FIG. 8.

A basic structure of the first embodiment of the developing apparatus according to the invention and used in the embodiment of the image-forming apparatus of FIG. 1 is the same as that of the conventional developing apparatus 18 illustrated in FIG. 9 and used in the conventional image-forming apparatus of FIG. 8, but the first embodiment is slightly different from the conventional developing apparatus 18. Therefore, the first embodiment is generally denoted by reference symbol 18*a*. Note that positional relationship between the various components in a housing 28 of the developing apparatus 18A and functions of the various components are the same as those of the corresponding components in the housing 28 of the conventional developing apparatus 18 of FIG. 8. Therefore, the components of the developing apparatus 18A of FIG. 2 that are the same as or similar to those of the conventional developing apparatus 18 of FIG. 9 are respectively denoted by the same reference symbols as those denoting the corresponding components of the conventional developing apparatus of FIG. 9, and their detailed description will be omitted.

The components in the housing 10 of the embodiment of FIG. 1 are arranged upside down relative to the components of the conventional image-forming apparatus of FIG. 8, so that transferring means 20 is arranged to face a top end portion of the peripheral surface of the image carrier 12. Therefore, a toner image on the image carrier 12 is transferred by transferring means 20 onto a printing medium supplied from a paper cassette 22*a* of printing medium supplying means 22 by a paper supplying roller 22*b* to the top end portion of the image carrier 12, and then the printing media on which the toner image have been transferred passes over the top end portion of the image carrier 12 and is moved to a discharged paper tray 24 through fixing means 26. This system by which the printing medium is passed over the top end portion of the image carrier 12 is referred to as on over pass system.

Contrary to this, in the conventional image-forming apparatus of FIG. 8, the transferring means 20 is arranged to face the lower end portion of the peripheral surface of the image carrier 12, the toner image on the image carrier 12 is transferred by the transferring means 20 onto the printing medium supplied from the paper cassette 22*a* of the printing medium supplying means 22 by the paper supplying roller 22*b* to the lower end portion of the image carrier 12, and then the printing media on which the toner image has been transferred is further moved from the lower end portion of the image carrier 12 to the discharged paper tray 24 through the fixing means 26. This system by which the printing medium is passed under the lower end of the image carrier 12 is referred to as an under pass system.

The over pass system used in the first embodiment of FIG. 1 is as popular as the under pass system used in the conventional image-forming apparatus of FIG. 8.

Figure 2:
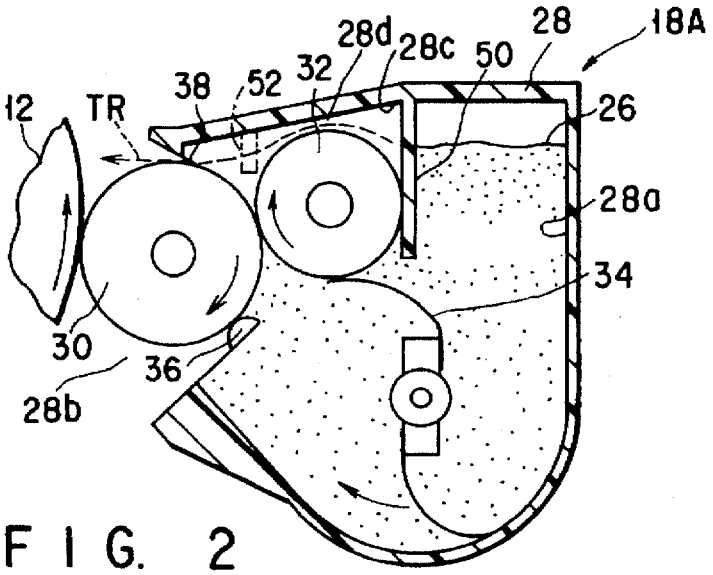
FIG. 2 is a longitudinal cross sectional view schematically showing a structure of the first embodiment of the developing apparatus used in the embodiment of the image-forming apparatus of FIG. 1.

FIG. 2 is a longitudinal cross sectional view schematically showing a structure of the first embodiment of the developing apparatus according to the invention and used in the embodiment of the image-forming apparatus of the over pass system in FIG. 1. Referring to FIG. 2, the developing apparatus 18A of the first embodiment is provided with a toner discharging aperture 28*b* at a region in an upper end portion of the peripheral wall of the housing 28, the region facing the peripheral surface of the image carrier 12. A developing roller 30 is rotatably arranged in the toner discharging aperture 28*b* as in the case of the conventional developing apparatus 18 of FIG. 9. Further, a toner supplying roller 32 and a toner stirring roller 34 are rotatably arranged in the toner holding space 28*a* as in the case of the conventional developing apparatus 18 of FIG. 9.

As in the case of the conventional developing apparatus 18 of FIG. 9, a toner leveling member 36 and a toner collecting member 38 both of which slidably contact the peripheral surface of the developing roller 30, are respectively fixed to two edges of the toner discharging aperture 28*b* at which the peripheral surface of the developing roller 30 is moved out from and is moved into the toner discharging aperture 28*b* in the predetermined rotating direction (the clockwise direction in FIG. 2) of the developing roller 30.

In the developing apparatus 18A of the embodiment, a predetermined amount of toner 26 is supplied into the toner holding space 28*a* of the housing 28 through a toner inlet opening (not shown) of the housing 28 in a final step for manufacturing the developing apparatus 18A in a factory, and the toner inlet opening is then sealed by a sealing member (not shown). It will be clearly seen by comparing the longitudinal cross sectional view of the embodiment of the developing apparatus 18A of FIG. 2 and that of the conventional developing apparatus 18 of FIG. 9, that, unlike the conventional developing apparatus 18 of FIG. 9, the developing apparatus 18A of FIG. 2 does not require the toner cartridge 40 having the internal space as large as the toner holding space 28*a* of the housing 28. Thus, the outer dimensions of the developing apparatus 18*a* of FIG. 2 are far smaller than those of the conventional developing apparatus 18 of FIG. 9. Likewise, the outer dimensions of the embodiment of the image-forming apparatus of FIG. 1 using the developing apparatus 18A of the first embodiment are far smaller than those of the conventional image-forming apparatus 18 of FIG. 8 using the conventional developing apparatus 18 of FIG. 9

The developing apparatus 18A of the first embodiment of FIG. 2 is structurally and functionally different from the conventional developing apparatus 18 of FIG. 9 by a sliding and closing member 50 formed on the inner surface of the housing 28 and slidably contacting the peripheral surface of the toner supplying roller 32 at a side opposite to the toner discharging aperture 28*b*.

Figure 3:
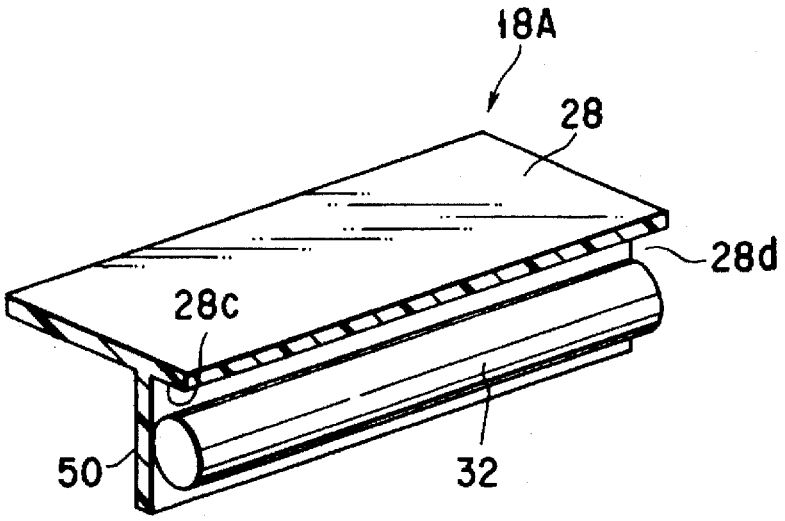
FIG. 3 is an enlarged perspective view showing a toner supplying roller and a sliding and closing member slidably contacting the toner supplying roller of the first embodiment of FIG. 2.

FIG. 3 is an enlarged perspective view showing only the toner supplying roller 32 and the sliding and closing member slidably contacting the toner supplying roller 32 of the first embodiment of FIG. 2. As shown in FIG. 3, the sliding and closing member 50 slidably contact the peripheral surface of the toner supplying roller 32 at the side opposite to the toner discharging aperture 28*b* in all of the width of the toner supplying roller 32 along a rotational center line of the toner supplying roller 32. Thus, the sliding and closing member 50 closes a gap 28*d* between the peripheral surface of the toner supplying roller 32 and the edge of the toner discharging aperture 28*b* at which the peripheral surface of the developing roller 30 is moved into the toner discharging aperture 28*b* in the predetermined rotating direction of the developing roller.

Since both ends of the sliding and closing member 50 are integrally formed with or attached to the oppositely disposed lateral side portions of the inner surface of the housing 28, the sliding and closing member 50 can function as a reinforcing rib of the housing 28 to improve its rigidity. Thus, the developing apparatus 18A of the first embodiment can effectively maintain its sealing effect which prevents the toner 26 from leaking out from the developing apparatus 18A even if the image-forming apparatus shown in FIG. 1 and using the developing apparatus 18A of the first embodiment is subjected to relatively large vibration and/or impact during transportation of the image-forming apparatus after it is shipped from the factory and before it is set at its using place.

Figure 4:
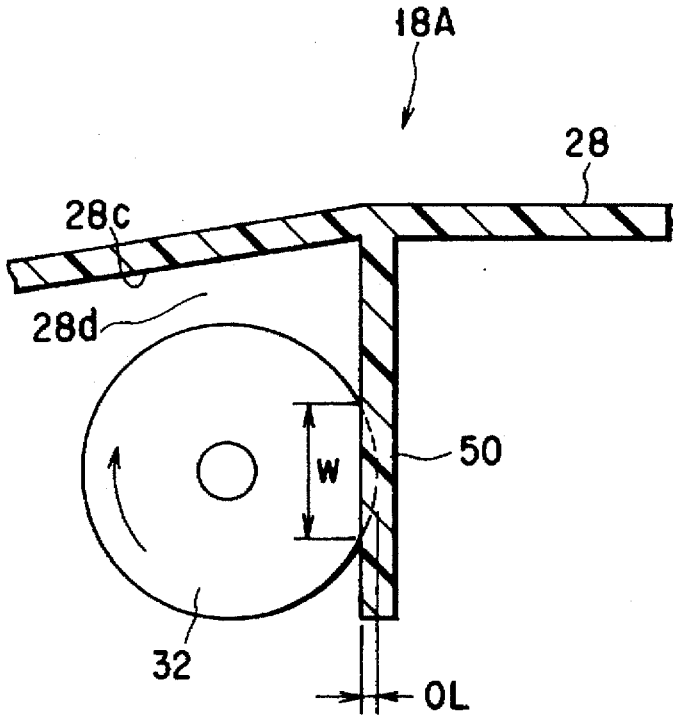
FIG. 4 is an enlarged side view of the toner supplying roller and the sliding and closing member slidably contacting the toner supplying roller of the first embodiment of FIG. 2.

FIG. 4 is an enlarged side view showing only the toner supplying roller 32 and the sliding and closing member 50 slidably contacting the toner supplying roller 32 of the first embodiment of FIG. 2. As shown in FIG. 4, the sliding and closing member 50 is pressed against the peripheral surface of the toner supplying roller 32 at the opposite side to be depressed by the peripheral surface of the toner supplying roller 32 by a depth OL of about 0.1 mm to about 3.00 mm, preferably about 0.4 mm to about 1.0 mm.

The above described values of the depression OL are obtained by the inventors of the present invention as a result of a series of experiments. And, the result of the experiments is as follows.

| | depression (nm) | | | | | | | | | | |
|---|---|---|---|---|---|---|---|---|---|---|---|
| tested effect | 0 | 0.1 | 0.2 | 0.4 | 0.6 | 0.8 | 1.0 | 1.5 | 2.0 | 3.0 | 4.0 |
| sealing effect during transportation | x | Δ | o | o | o | o | o | o | o | o | o |
| durability of toner supplyig roller 32 | o | o | o | o | o | o | o | o | o | o | x |
| toner-clogging preventing effect in toner supplying roller 32 | o | o | o | o | o | o | o | o | Δ | Δ | x |
| | | | | | optimum range | | | | | | |

o . . . good
x . . . not good
Δ . . . permissible

From the result of the experiments, the depth OL of the depression of about 0.4 mm to about 1.0 mm brings a superior sealing effect of the sliding and closing member 50 to the toner supplying roller 32 while the image-forming apparatus is transferred, a superior durability of the toner supplying roller 32 and a superior toner-clogging preventing effect that prevents the toner from clogging at a position on the peripheral surface of the toner supplying roller 32 at which the sliding and closing member 50 is pressed against the toner supplying roller 32. The depth of about 0.1 mm to less than 0.4 mm (not including 0.4 mm) and more than 1 mm (not including 1 mm) to about 3.0 mm can bring the sealing effect and the toner-clogging preventing effect both of which are slightly inferior to those brought by the depth of about 0.4 mm to about 1 mm but there is no problem in practical case.

Further, since the sliding and closing member 50 is pressed against the peripheral surface of the toner supplying roller 32 at the side opposite to the toner discharging aperture 28*b*, the sliding and closing member 50 can make a surface contact with the peripheral surface of the toner supplying roller 32 over a relatively large area having a width W so that the toner 26 scraped from the peripheral surface of the toner supplying roller 32 by the sliding and closing member 50 would not deposit on the depressed portion of the sliding and closing member 50.

A partitioning projection 52 can be projected from the inner surface of the housing 28 at a position closer than the sliding and closing member 50 to the gap between the peripheral surface of the developing roller 30 and the edge of the toner discharging aperture 28*b* at which the peripheral surface of the developing roller 30 is moved into the toner discharge aperture 28*b* in the predetermined rotating direction of the developing roller 30. The partitioning projection 52 partitions a region of the toner holding space 28*a* defined by a portion the inner surface of the housing 28 between the gap of the developing roller-moving into side and the sliding and closing member 50, and by the peripheral surface of the developing roller 30.

If the sliding and closing member 50 and/or the toner supplying roller 32 are worn in accordance with an increase of the operating time of the developing apparatus 18A and the image-forming apparatus using the developing apparatus 18A, and thus the pressure applied to the toner supplying roller 32 by the sliding and closing member 50 is reduced to produce a gap between the toner supplying roller 32 and the sliding and closing member 50 so that the toner 26 can be leaked out through the gap, the partitioning projection 52 effectively prevents the toner 26 from leaking out from the developing apparatus 18A as indicated by an arrow TR of the broken line through the gap between the peripheral surface of the developing roller 30 and the edge of the toner discharging aperture 28*b* at which the peripheral surface of the developing roller 30 is moved into the toner discharging aperture 28*b* in the predetermined rotational direction of the developing roller 30, particularly through the gap between the toner collecting member 38 and the developing roller 30.

Figure 5:
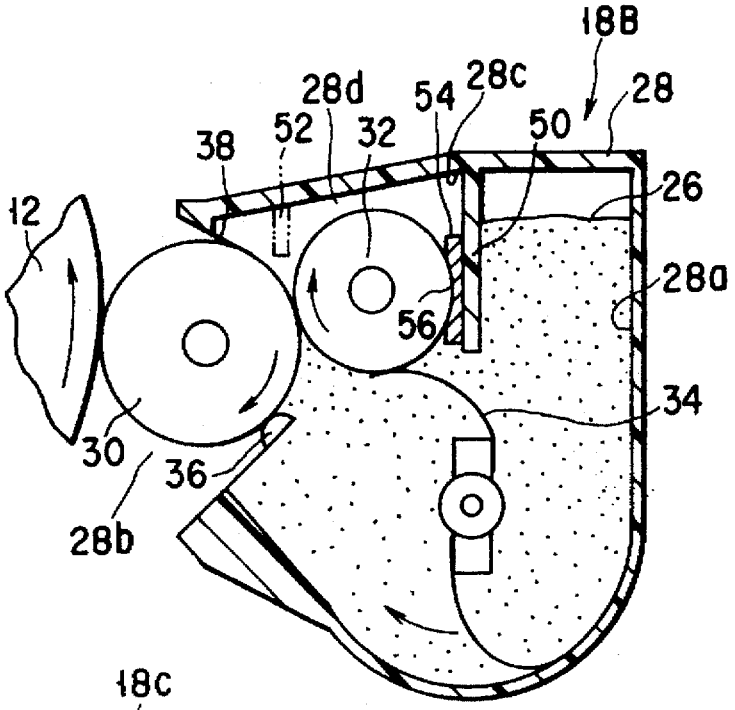
FIG. 5 is a longitudinal cross sectional view schematically showing a second embodiment of the developing apparatus according to the invention that can be used in the embodiment of the image-forming apparatus of FIG. 1.

FIG. 5 is a longitudinal cross sectional view schematically showing a structure of a second embodiment of the developing apparatus according to the invention that can be used in the embodiment of the image-forming apparatus of FIG. 1. As in the case of the developing apparatus 18A of the first embodiment described above with reference to FIGS. 2 through 4, a basic structure of the second embodiment of the developing apparatus is the same as that of the conventional developing apparatus 18 illustrated in FIG. 9 and used in the conventional image-forming apparatus of FIG. 8, but the second embodiment is slightly different from the conventional developing apparatus 18. Therefore, the second embodiment is generally denoted by reference symbol 18B. And, as in the case of the developing apparatus 18A of the first embodiment of FIG. 2, the components of the developing apparatus 18B of FIG. 5 that are the same as or similar to those of the developing apparatus 18 of FIG. 9 are respectively denoted by the same reference symbols as those denoting the corresponding components of FIG. 9, and their detailed description will be omitted.

In the developing apparatus 18B of the second embodiment, the sliding and closing member 50 is provided with an elastic member 54 in a region where the sliding and closing member 50 is in sliding contact with the peripheral surface of the toner supplying roller 32. The elastic member 54 may be made of maltprene, chloroprene or foamed urethane. Like the sliding and closing member 50 of the first embodiment, the elastic member 54 is pressed against the peripheral surface of the toner supplying roller 32 to be depressed by the peripheral surface of the toner supplying roller 32 by the same depth as the depth OL of the depression formed in the sliding and closing member 50 of the first embodiment. The surface of the elastic member 54 is provide with a film or tape 56 of a polymeric material such as polyethylene glycol therephthalate (Mylar: tradename—available from Du pont), polycarbonate, plyimide or nylon in a region where the elastic member 54 is in sliding contact with the toner supplying roller 32. The film or tape 56 of the polymeric material can increase the fitness of the elastic member 54 to the peripheral surface of the toner supplying roller 32 and reduce the friction between them. Hence, such a film or tape 56 can increase the sealing effect of the elastic member 54 to the peripheral surface of the toner supplying roller 32, the durability of the elastic member 54 and the toner supplying roller 32, and the toner-clogging preventing effect.

It will be understood that, as in the case of the developing apparatus 18A of the first embodiment, the developing apparatus 18B of the second embodiment may be provided with a partitioning projection 52 as illustrated in FIG. 5.

Figure 6:
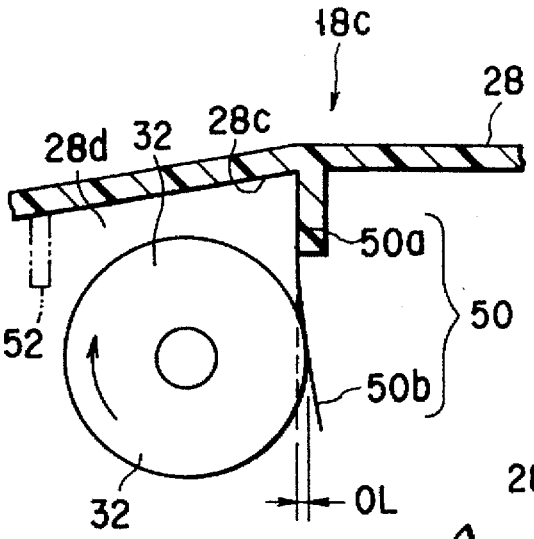
FIG. 6 is a longitudinal cross sectional view schematically showing a structure of a main portion of a third embodiment of the developing apparatus according to the invention that can be used in the embodiment of the image-forming apparatus of FIG. 1.

FIG. 6 is a longitudinal cross sectional view schematically showing a main portion of a structure of a third embodiment of the developing apparatus according to the invention that can be used in the embodiment of the image-forming apparatus of FIG. 1. As in the case of the developing apparatus 18A of the first embodiment described above with reference to FIGS. 2 through 4, a basic structure of the third embodiment of the developing apparatus according to the invention and used in the embodiment of the image-forming apparatus of FIG. 1 is the same as that of the conventional developing apparatus 18 illustrated in FIG. 9 and used in the conventional image-forming apparatus of FIG. 8, but the third embodiment is slightly different from the conventional developing apparatus 18. Therefore, the third embodiment is generally denoted by reference symbol 18C. Therefore, as in the case of the developing apparatus 18A of the first embodiment of FIG. 2, the components of the developing apparatus 18C of FIG. 6 that are the same as or similar to those of the developing apparatus 18 of FIG. 9 are respectively denoted by the same reference symbols as those denoting the corresponding components of FIG. 9, and their detailed description will be omitted.

In the developing apparatus 18C of the third embodiment, the sliding and closing member 50 arranged on the inner surface of the housing 28 and slidably contacting the peripheral surface of the toner supplying roller 32 at a side opposite to the toner discharging aperture **28*b* is composed of a reinforcing rib 50*a* formed on or attached to the inner surface of the housing 28 and a plastic or metal thin plate 50*b* firmly secured to the reinforcing rib 50*a***.

The reinforcing rib **50*a* and the thin plate 50*b* of the sliding and closing member 50 are extending along the rotational center line of the toner supplying roller 32 over the entire of a width of the peripheral surface of the toner supplying roller 32. And, the thin plate 50*b* slidably contact the peripheral surface of the toner supplying roller 32 at the opposite side over the entire of the width of the peripheral surface of the toner supplying roller 32. Thus, the sliding and closing member 50 closes the gap 28*d* in the toner holding space 28*a* between the peripheral surface of the toner supplying roller 32 and the edge of the toner discharging aperture 28*b* at which the peripheral surface of the developing roller 30 is moved into the toner discharging aperture 28*b* in the predetermined rotational direction of the developing roller 30**.

If both ends of the reinforcing rib sliding the sliding and closing member 50 are integrally formed with or attached to the oppositely disposed lateral side portions of the inner surface of the housing 28, the sliding and closing member 50 functions as a reinforcing rib of the housing 28 to improve its rigidity. The thin plate **50*b* is pressed against the peripheral surface of the toner supplying roller 32 to be bent and depressed by the peripheral surface of the toner supplying roller 32 by the same depth as the depth OL of the depression formed in the sliding and closing member 50** of the first embodiment.

It will be understood that, as in the case of the developing apparatus 18A of the first embodiment, the developing apparatus 18C of the third embodiment may be provided with a partitioning projection 52 as illustrated in FIG. 6.

Figure 7:
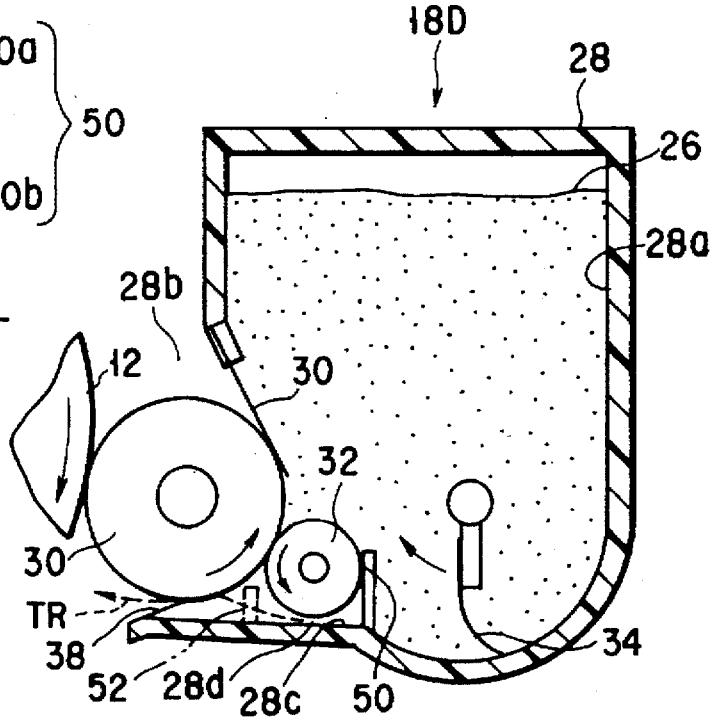
FIG. 7 is a longitudinal cross sectional view schematically showing a structure of a fourth embodiment of the developing apparatus according to the invention that can be used in another embodiment of the image-forming apparatus according to the invention, the another embodiment of the image-forming apparatus being structured by inverting the structure of the embodiment of the image-forming apparatus of FIG. 1 upside down.

FIG. 7 is a longitudinal cross sectional view schematically showing a structure of a fourth embodiment of the developing apparatus according to the invention and being able to be used in another embodiment of the image-forming apparatus according to the invention, the another embodiment of the image-forming apparatus being structured by inverting the structure of the embodiment of the image-forming apparatus of FIG. 1 upside down.

Thus, this embodiment structured by inverting the structure of the embodiment of FIG. 1 upside down has the same structure as that of the conventional image-forming apparatus of FIG. 8, so that this embodiment is the under pass system. A basic structure of the fourth embodiment of the developing apparatus according to the invention and used in another embodiment of the image-forming apparatus having the same structure as that of the conventional image-forming apparatus of FIG. 8 is the same as that of the conventional developing apparatus 18 illustrated in FIG. 9 and used in the conventional image-forming apparatus of FIG. 8, but the fourth embodiment is slightly different from the conventional developing apparatus 18. Therefore, the fourth embodiment is generally denoted by reference symbol 18D. And, as in the case of the developing apparatus 18A of the first embodiment of FIG. 2, the components of the developing apparatus 18D of FIG. 7 that are the same as or similar to those of the developing apparatus 18 of FIG. 9 are respectively denoted by the same reference symbols as those denoting the corresponding components of FIG. 9, and their detailed description will be omitted.

Referring to FIG. 7, like the conventional developing apparatus 18 of FIG. 9, the developing apparatus 18D of the fourth embodiment is provided with an toner discharging aperture **28*b* in a lower end portion of the peripheral wall of a housing 28 at a region facing a peripheral surface of an image carrier 12. A developing roller 30 is rotatably arranged in the toner discharging aperture 28*b* as in the case of the conventional developing apparatus 18 of FIG. 9. Likewise, a toner supplying roller 32 and a toner stirring roller 34 are rotatably arranged in the toner holding space 28a**.

As in the case of the conventional developing apparatus 18 of FIG. 9, a toner leveling member 36 and a toner collecting member 38 are respectively secured to the oppositely disposed edges of the toner discharging aperture **28*b* at one of which the peripheral surface of the developing roller 30 is moved out from the toner discharging aperture 28*b* in the predetermined rotational direction of the developing roller 30 indicated by an arrow in FIG. 2 (the counterclockwise direction in FIG. 7) and at the other of which the peripheral surface of the developing roller 30 is moved into the toner discharging aperture 28*b* in the predetermined rotational direction. The toner leveling member 36 and the toner collecting member 38 are in slidable contact with the peripheral surface the developing roller 30**.

A sliding and closing member 50 is provided on the inner surface of the housing 28 and slidably contact the peripheral surface of the toner supplying roller 32 at a side opposite to the toner discharging aperture **28*b* in all of the width of the toner supplying roller 32 along a rotational center line of the toner supplying roller 32. Thus, the sliding and closing member 50 closes a gap 28*d* between the peripheral surface of the toner supplying roller 32 and the edge of the toner discharging aperture 28*b* at which the peripheral surface of the developing roller 30 is moved into the toner discharging aperture 28*b* in the predetermined rotational direction of the developing roller 30**.

The sliding and closing member 50 of the fourth embodiment can be structured as the sliding and closing member 50 of the first embodiment of FIG. 2, the sliding and closing member 50 of the second embodiment of FIG. 5 and the sliding and closing member 50 of the third embodiment of FIG. 6

It will be understood that, as in the case of the first embodiment of FIG. 2, the second embodiment of FIG. 5 and the third embodiment of FIG. 6, the developing apparatus 18D of the fourth embodiment of FIG. 7 may also be provided with a partitioning projection 52. Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus for developing a latent image formed on a surface of an image carrier with toner, comprising:

a housing having a toner holding space for holding the toner, and a toner discharging aperture for discharging the toner in the toner holding space to the outer space;

a developing roller rotatably held in the toner discharging aperture of the housing and rotated in a predetermined direction;

a toner leveling member closing a gap between a peripheral surface of the developing roller and an edge of the toner discharging aperture at which the peripheral surface of the developing roller is moved out from the toner discharging aperture in the predetermined rotating direction of the developing roller, and slidably pressed against the peripheral surface of the developing roller;

a toner supplying roller rotatably held in the toner holding space and pressed against the peripheral surface of the developing roller; and a sliding and closing member closing a gap between the peripheral surface of the toner supplying roller and a portion of the inner surface of the housing corresponding to a gap between the peripheral surface of the developing roller and an edge of the toner discharging aperture at which the peripheral surface of the developing roller is moved into the toner discharging aperture in the predetermined rotating direction of the developing roller, and slidably pressed against the peripheral surface of the toner supplying roller, the sliding and closing member having such a stiffness that keeps the sliding and closing member in contact with the peripheral surface of the developing roller when impact or vibration is applied to the developing apparatus, and preventing the toner from escaping through the gap from the toner discharging aperture to the outer space, and wherein:

the peripheral surface of the developing roller is arranged to face the surface of the image carrier on which the latent image is formed, the toner is supplied to the peripheral surface of the developing roller in the toner holding space by the rotation of the toner supplying roller, the toner is leveled by the toner leveling member on the peripheral surface of the developing roller by the rotation of the developing roller in its predetermined rotating direction, the toner is supplied from the peripheral surface of the developing roller to the surface of the image carrier, and the latent image on the surface of the image carrier is developed by the toner.

2. A developing apparatus according to claim 1, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

3. A developing apparatus according to claim 1, wherein the sliding and closing member is pressed onto a peripheral surface of the toner supplying roller by a depth of about 0.1 mm to about 3.0 mm.

4. A developing apparatus according to claim 3, wherein the depth of the depression of the sliding and closing member is about 0.4 mm to about 1.00 mm.

5. A developing apparatus according to claim 3, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

6. A developing apparatus according to claim 1, wherein the sliding and closing member is provided with an elastic member in a region where the sliding and closing member is in sliding contact with the peripheral surface of the toner supplying roller.

7. A developing apparatus according to claim 6, wherein the elastic member is provided with a film or tape of a polymeric material in a region where the elastic member is in sliding contact with the peripheral surface of the toner supplying roller.

8. A developing apparatus according to claim 6, wherein the sliding and closing member is pressed onto a peripheral surface of the toner supplying roller by a depth of about 0.1 mm to about 3.0 mm.

9. A developing apparatus according to claim 8, wherein the depth of the depression of the sliding and closing member is about 0.4 mm to about 1.00 mm.

10. A developing apparatus according to claim 6, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

11. A developing apparatus according to claim 1, wherein the sliding and closing member projects from the housing toward the peripheral surface of the developing roller and has a projecting end portion slidably pressed against the peripheral surface of the toner supplying roller.

12. A developing apparatus according to claim 11, wherein the sliding and closing member is formed integrally with the housing.

13. An image-forming apparatus comprising:

an image carrier on a surface of which a latent image is formed;

a developing apparatus for developing the latent image formed on the surface of the image carrier with toner;

a printing medium supplying unit for supplying a printing medium to the image carrier; and a transferring/fixing unit for transferring the toner image on the image carrier developed by the developing apparatus onto the printing medium supplied by the printing medium supplying unit, and fixing the transferred image on the printing medium;

wherein said developing apparatus includes:

a housing having a toner holding space for holding the toner and a toner discharging aperture for discharging the toner in the toner holding space to the outer space;

a developing roller rotatably held in the toner discharging aperture of the housing and rotated in a predetermined direction;

a toner leveling member closing a gap between a peripheral surface of the developing roller and an edge of the toner discharging aperture at which the peripheral surface of the developing roller is moved out from the toner discharging aperture in the predetermined rotating direction of the developing roller, and slidably pressed against the peripheral surface of the developing roller;

a toner supplying roller rotatably held in the toner holding space and pressed against the peripheral surface of the developing roller; and a sliding and closing member closing a gap between the peripheral surface of the toner supplying roller and a portion of the inner surface of the housing corresponding to a gap between the peripheral surface of the developing roller and an edge of the toner discharging aperture at which the peripheral surface of the developing roller is moved into the toner discharging aperture in the predetermined rotating direction of the developing roller, and slidably pressed against the peripheral surface of the toner supplying roller, the sliding and closing member having such a stiffness that keeps the sliding and closing member in contact with the peripheral surface of the developing roller when impact or vibration is applied to the developing apparatus, and preventing the toner from escaping through the gap from the toner discharging aperture to the outer space, and wherein:

the peripheral surface of the developing roller is arranged to face the surface of the image carrier on which the latent image is formed, the toner is supplied to the peripheral surface of the developing roller in the toner holding space by the rotation of the toner supplying roller, the toner is leveled by the toner leveling member on the peripheral surface of the developing roller by the rotation of the developing roller in its predetermined rotating direction, the toner is supplied from the peripheral surface of the developing roller to the surface of the image carrier, and the latent image on the surface of the image carrier is developed by the toner.

14. An image-forming apparatus according to claim 13, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

15. An image-forming apparatus according to claim 13, wherein the sliding and closing member projects from the housing toward the peripheral surface of the developing roller and has a projecting end portion slidably pressed against the peripheral surface of the toner supplying roller.

16. An image-forming apparatus according to claim 15, wherein the sliding and closing member is formed integrally with the housing.

17. An image-forming apparatus according to claim 15, wherein the sliding and closing member is pressed onto a peripheral surface of the toner supplying roller by a depth of about 0.1 mm to about 3.0 mm.

18. An image-forming apparatus according to claim 17, wherein the depth of the depression of the sliding and closing member is about 0.4 mm to about 1.00 mm.

19. An image-forming apparatus according to claim 17, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

20. An image-forming apparatus according to claim 15, wherein the sliding and closing member is provided with an elastic member in a region where the sliding and closing member is in sliding contact with the peripheral surface of the toner supplying roller.

21. An image-forming apparatus according to claim 20, wherein the elastic member is provided with a film or tape of a polymeric material in a region where the elastic member is in sliding contact with the peripheral surface of the toner supplying roller.

22. An image-forming apparatus according to claim 20, wherein the sliding and closing member is pressed onto a peripheral surface of the toner supplying roller by a depth of about 0.1 mm to about 3.0 mm.

23. An image-forming apparatus according to claim 22, wherein the depth of the depression of the sliding and closing member is about 0.4 mm to about 1.00 mm.

24. An image-forming apparatus according to claim 20, further comprising a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

25. A developing apparatus for developing a latent image formed on a surface of an image carrier with toner, comprising:

a housing having a toner holding space for holding the toner, and a toner discharging aperture for discharging the toner in the toner holding space to the outer space;

a developing roller rotatably held in the toner discharging aperture of the housing and rotated in a predetermined direction;

a toner leveling member closing a gap between a peripheral surface of the developing roller and an edge of the toner discharging aperture at which the peripheral surface of the developing roller is moved out from the toner discharging aperture in the predetermined rotating direction of the developing roller, and slidably pressed against the peripheral surface of the developing roller;

a toner supplying roller rotatably held in the toner holding space and pressed against the peripheral surface of the developing roller;

a sliding and closing member closing a gap between the peripheral surface of the toner supplying roller and a portion of the inner surface of the housing corresponding to a gap between the peripheral surface of the developing roller and an edge of the toner discharging aperture at which the peripheral surface of the developing roller is moved into the toner discharging aperture in the predetermined rotating direction of the developing roller, and slidably pressed against the peripheral surface of the toner supplying roller, wherein the peripheral surface of the developing roller is arranged to face the surface of the image carrier on which the latent image is formed, the toner is supplied to the peripheral surface of the developing roller in the toner holding space by the rotation of the toner supplying roller, the toner is leveled by the toner leveling member on the peripheral surface of the developing roller by the rotation of the developing roller in its predetermined rotating direction, the toner is supplied from the peripheral surface of the developing roller to the surface of the image carrier, and the latent image on the surface of the image carrier is developed by the toner; and a partitioning projection projecting from the inner surface of the housing at a position closer than the sliding and closing member to the gap between the peripheral surface of the developing roller and the edge of the toner discharging aperture at which the peripheral surface of the developing roller is moved into the toner discharging aperture in the predetermined rotating direction of the developing roller, and partitioning a region of the toner holding space defined by a portion of the inner surface of the housing between the gap of the developing roller moving-into side and the sliding and closing member, and by the peripheral surface of the developing roller.

26. A developing apparatus according to claim 25, wherein the sliding and closing member is pressed onto a peripheral surface of the toner supplying roller by a depth of about 0.1 mm to about 3.0 mm.

* * * * *